US010466630B2

(12) United States Patent
Ando

(10) Patent No.: US 10,466,630 B2
(45) Date of Patent: Nov. 5, 2019

(54) TEMPERATURE MEASURING DEVICE, FIXING DEVICE, AND IMAGE FORMING APPARATUS

(71) Applicant: TOSHIBA TEC KABUSHIKI KAISHA, Tokyo (JP)

(72) Inventor: Masao Ando, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/047,286

(22) Filed: Jul. 27, 2018

(65) Prior Publication Data

US 2019/0121266 A1 Apr. 25, 2019

(30) Foreign Application Priority Data

Oct. 25, 2017 (JP) ..... 2017-205984

(51) Int. Cl.
*G03G 15/20* (2006.01)

(52) U.S. Cl.
CPC ..... *G03G 15/2039* (2013.01)

(58) Field of Classification Search
USPC ..... 399/69
See application file for complete search history.

(56) References Cited

U.S. PATENT DOCUMENTS 8,185,008 B2 * 5/2012 Sato ..... G03G 15/2053 399/122
9,501,035 B2 11/2016 Naruse et al.
2005/0053390 A1 * 3/2005 Suzuki ..... G01J 5/0022 399/69
2008/0240748 A1 * 10/2008 Kinouchi ..... G03G 15/2039 399/33
2017/0364002 A1 12/2017 Ando

FOREIGN PATENT DOCUMENTS

DE 10016349 A1 * 10/2001 ..... G01J 1/04
JP 01298384 A * 12/1989 ..... G03G 15/201

* cited by examiner

*Primary Examiner* — Quana Grainger
(74) *Attorney, Agent, or Firm* — Kim & Stewart LLP

(57) ABSTRACT

A temperature measuring device for measuring temperatures of a plurality of heating elements, includes a temperature measuring element positioned to receive infrared rays emitted from each of the heating elements and to output a signal corresponding to an intensity of the light reception, and a light guiding unit including a plurality of light guides, one for each of the heating elements, each light guide being configured to guide the infrared ray emitted from a respective one of the heating elements to the temperature measuring element.

14 Claims, 14 Drawing Sheets

TEMPERATURE MEASURING DEVICE, FIXING DEVICE, AND IMAGE FORMING APPARATUS

CROSS-REFERENCE TO RELATED APPLICATION

This application is based upon and claims the benefit of priority from Japanese Patent Application No. 2017-205984, filed Oct. 25, 2017, the entire contents of which are incorporated herein by reference.

FIELD

Embodiments described herein relate generally to a temperature measuring device, a fixing device, and an image forming apparatus.

BACKGROUND

An image forming apparatus such as a multi-function peripheral is provided with a fixing device for fixing a toner image on a paper. In the fixing device, for example, a temperature of a heater or a fixing belt of the fixing device, by which the paper is heated, is measured using a temperature measuring element such as a thermistor or a thermopile.

A fixing device included in a recent image forming apparatus is provided with a heater of which heating unit is divided in a direction orthogonal to a paper conveying direction in the fixing device and which is capable of suppressing power consumption when heating a paper by selectively heating the divided heating unit according to a paper size. Therefore, when measuring the temperature for each heating unit, a plurality of temperature measuring elements are required.

DETAILED DESCRIPTION

Embodiments simplify the configuration of a fixing device by performing measurement of a plurality of portions with a common element.

In general, according to one embodiment, there is provided a temperature measuring device for measuring temperatures of a plurality of heating elements, which includes a temperature measuring element positioned to receive infrared rays emitted from each of the heating elements and to output a signal corresponding to an intensity of the light reception, and a light guiding unit including a plurality of light guides, one for each of the heating elements, each light guide being configured to guide the infrared ray emitted from a respective one of the heating elements to the temperature measuring element.

Hereinafter, an image forming apparatus according to the present embodiment will be described with reference to the drawings. For the explanation, an XYZ coordinate system consisting of X axis, Y axis, and Z axis which are mutually orthogonal is appropriately used.

Figure 1:
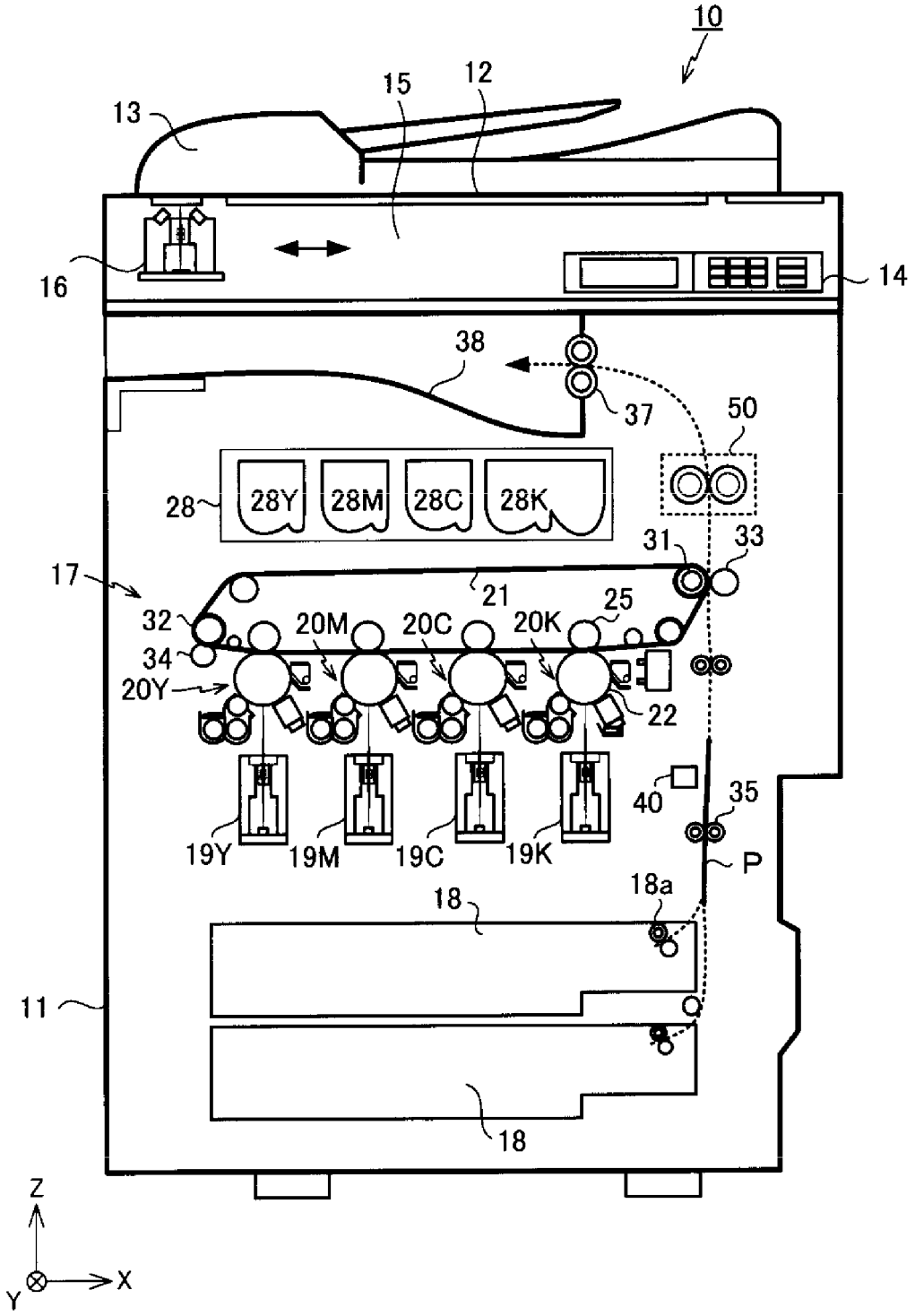
FIG. 1 is a diagram illustrating a configuration of an image forming apparatus according to an embodiment.

FIG. 1 is a diagram illustrating a configuration of an image forming apparatus according to an embodiment. An image forming apparatus 10 is, for example, a multi-function peripheral (MFP). The image forming apparatus 10 includes a main body 11 and an auto document feeder (ADF) 13 disposed above the main body 11. An original platen 12 made of transparent glass is provided at the top of the main body 11, and the ADF 13 is provided on an upper surface side of the original platen 12 to be openable and closable. An operation unit 14 is provided at upper position of the main body 11. The operation unit 14 includes an operation panel with various keys and a touch panel type display, for example.

A scanner unit 15 for reading an original document is disposed under the original platen 12. The scanner unit 15 reads an original document being conveyed by the ADF 13 or an original document placed on the original platen 12 and generates image data. The scanner unit 15 is provided with an image sensor 16.

When reading an image on an original document placed on the original platen 12, the image sensor 16 reads the image on the original document while moving in a +X direction along the lower surface of the original platen 12. When reading an image on the original document being conveyed by the ADF 13, the image sensor 16 is stopped at a position illustrated in FIG. 1 and reads images on the original documents being sequentially conveyed by the ADF 13 one by one.

Inside the main unit 11, an image forming unit 17 and a plurality of paper feeding cassettes 18 for accommodating papers of various sizes are provided.

The image forming unit 17 processes image data read by the scanner unit 15 or image data received from any external device and the like, and forms an image on a reading medium such as a paper accommodated in the paper feeding cassette 18.

The image forming unit 17 includes image forming units 20Y, 20M, 20C, and 20K corresponding to yellow (Y), magenta (M), cyan (C), and black (K) respectively, scan heads 19Y, 19M, 19C, and 19K provided according to the image forming units, an intermediate transfer belt 21 and the like.

The image forming units 20Y, 20M, 20C, and 20K are disposed below the lower surface of the circumferential surface of the intermediate transfer belt 21. In the image forming unit 17, the image forming units 20Y, 20M, 20C, and 20K are arranged along the lower surface of the circumferential surface of the intermediate transfer belt 21 from −X side to +X side. The scan heads 19Y, 19M, 19C, and 19K are disposed below the image forming units 20Y, 20M, 20C, and 20K, respectively.

Figure 2:
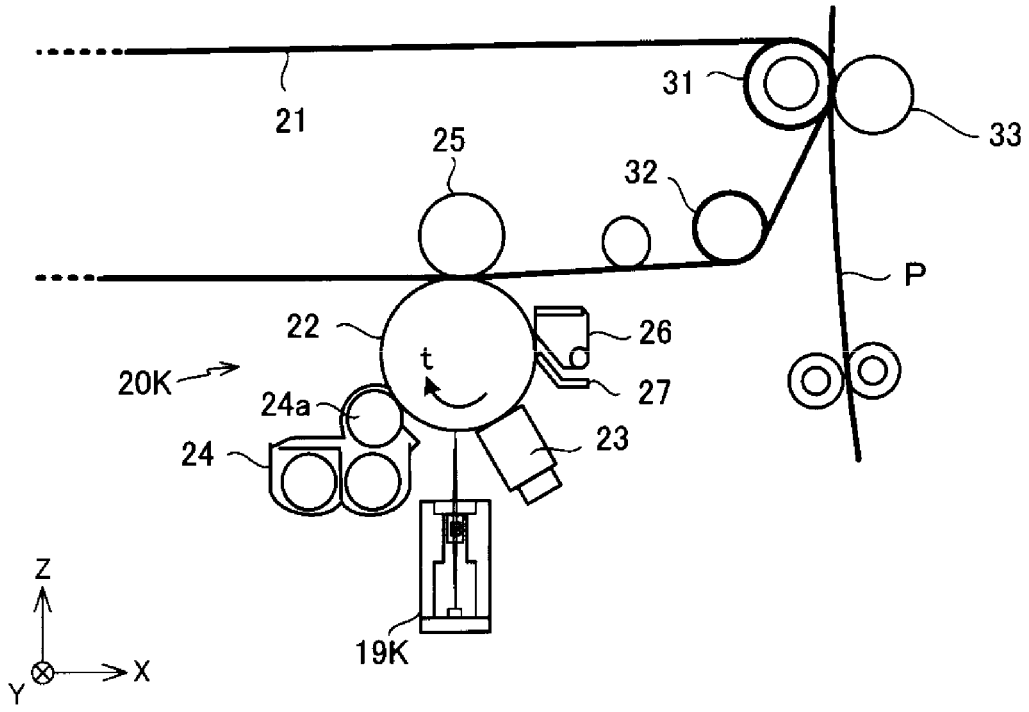
FIG. 2 is an enlarged diagram of an image forming unit.

FIG. 2 is an enlarged diagram of the image forming unit 20K among the image forming units 20Y, 20M, 20C, and 20K. Each of the image forming units 20Y, 20M, 20C, and 20K has substantially the same configuration. Therefore, the configuration of each image forming unit will be explained with the image forming unit 20K as a representative example.

The image forming unit 20K includes a photoconductive drum 22 as an image carrier. Around the outer circumferential surface of the photoconductive drum 22, an electrostatic charger 23, a developing device 24, a primary transfer roller 25, a cleaner 26, a blade 27, and the like are arranged along a direction indicated by an arrow t. Light emitted from the scan head 19K is applied to an exposure position of the outer circumferential surface of the photoconductive drum 22. As a result, an electrostatic latent image is formed on the outer circumferential surface of the photoconductive drum 22.

The electrostatic charger 23 of the image forming unit 20K uniformly charges the outer circumferential surface of the photoconductive drum 22. The developing device 24 supplies a toner onto the photoconductive drum 22 by a developing roller 24*a* to which developing bias is applied and develops the electrostatic latent image with the toner. The cleaner 26 removes residual toner on the surface of the photoconductive drum 22 using the blade 27.

As illustrated in FIG. 1, a holder 28 that configured to hold toner cartridges for supplying toner to each developing device 24 is provided above the image forming units 20Y to 20K. Toner cartridges 28Y, 28M, 28C, and 28K corresponding to yellow (Y), magenta (M), cyan (C), and black (K) respectively are accommodated in the holder 28.

The intermediate transfer belt 21 is tensioned by a driving roller 31 and a driven roller 32 around which the intermediate transfer belt 21 is wound. The intermediate transfer belt 21 is rotated counterclockwise in FIG. 1 by the rotation of the driving roller 31. As illustrated in FIG. 1, the lower surface of the outer circumferential surface of the intermediate transfer belt 21 comes into contact with an upper surface of the outer circumferential surface of each photoconductive drum 22 of the image forming units 20Y, 20M, 20C, and 20K. A primary transfer voltage is applied to a position of the intermediate transfer belt 21 that faces the photoconductive drum 22 by the primary transfer roller 25. As a result, the toner image on the surface of the photoconductive drum 22 is transferred onto the outer circumferential surface of the intermediate transfer belt 21.

A secondary transfer roller 33 is disposed so as to face the driving roller 31 across the intermediate transfer belt 21. When paper P passes between the outer circumferential surface of the intermediate transfer belt 21 and the secondary transfer roller 33, a secondary transfer voltage is applied to the paper P through the secondary transfer roller 33. As a result, the toner image on the outer circumferential surface of the intermediate transfer belt 21 is transferred onto the paper P. As illustrated in FIG. 1, a belt cleaner 34 is provided in a vicinity of the driven roller 32 of the intermediate transfer belt 21. The residual toner on the outer circumferential surface of the intermediate transfer belt 21 is removed by the belt cleaner 34.

As illustrated in FIG. 1, a paper feeding roller 35 is provided between the paper feeding cassette 18 and the secondary transfer roller 33 in a paper conveying direction. The paper P taken out from either one of the paper feeding cassettes 18 by a pickup roller 18*a* disposed in a vicinity of the paper feeding cassette 18 is conveyed between the intermediate transfer belt 21 and the secondary transfer roller 33 by the paper feeding roller 35 in the paper conveying direction.

A fixing device 50 is provided on the downstream side of the secondary transfer roller 33 in the paper conveying direction. A paper discharge roller 37 is disposed on the downstream side of the fixing device 50 in the paper conveying direction. The toner image transferred onto the paper P that passed between the intermediate transfer belt 21 and the secondary transfer roller 33 is heated by the fixing device 50. As a result, the toner image is fixed on the paper P. The paper P passed through the fixing device 50 is discharged to a paper discharge portion 38 by the paper discharge roller 37.

Figure 3:
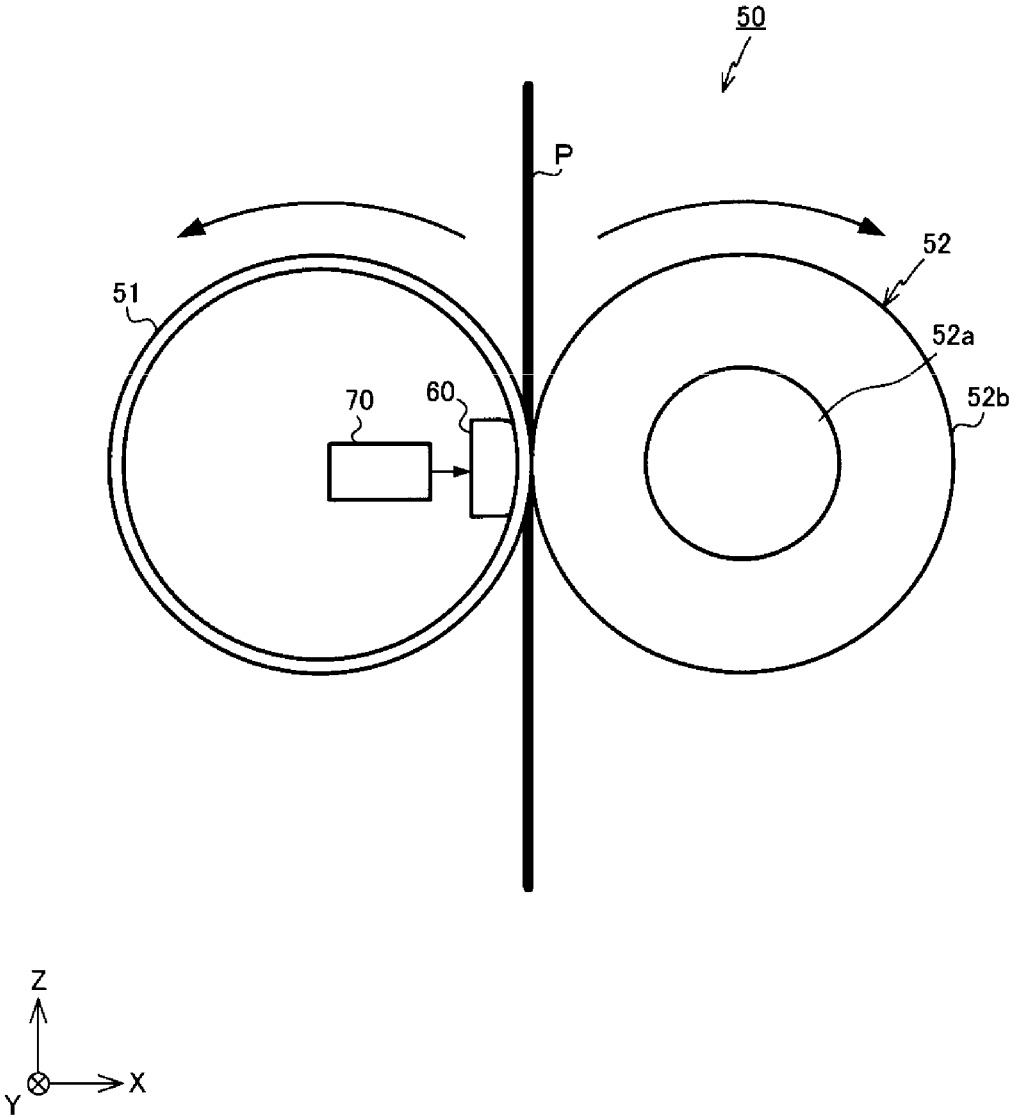
FIG. 3 is a diagram illustrating an example of a fixing device.

FIG. 3 is a diagram illustrating an example of the fixing device 50. The fixing device 50 includes a fixing belt 51, a press roller 52, a heater 60 disposed inside the fixing belt 51, and a temperature measuring unit 70.

The fixing belt 51 is a tubular member having a longitudinal direction thereof as a Y axis direction and the length thereof is longer than a width of the paper P to be heated (dimension in Y axis direction). The fixing belt 51 is, for example, a member made of a polyimide sleeve. On the outer side of the fixing belt 51, a metal layer such as a Ni layer, or a Cu layer is formed. The fixing belt 51 is supported so as to be rotatable around an axis parallel to the Y axis.

Figure 4:
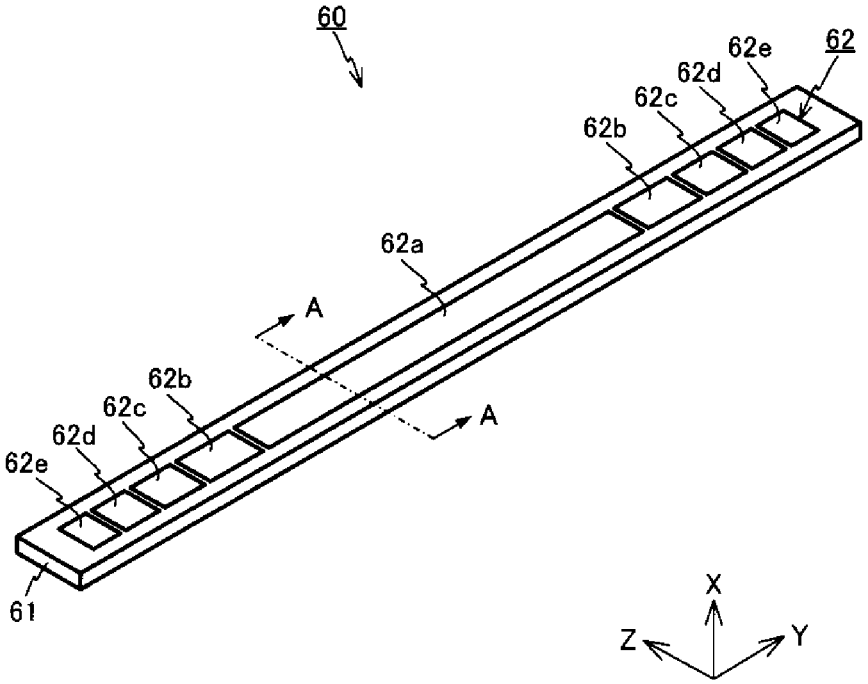
FIG. 4 is a perspective view of a heater.

FIG. 4 is a perspective view of the heater 60. The heater 60 is a rectangular member having a longitudinal direction thereof as the Y axis direction. The heater 60 includes a substrate 61 having a longitudinal direction thereof as the Y axis direction. The substrate 61 is, for example, made of ceramic.

Figure 5:
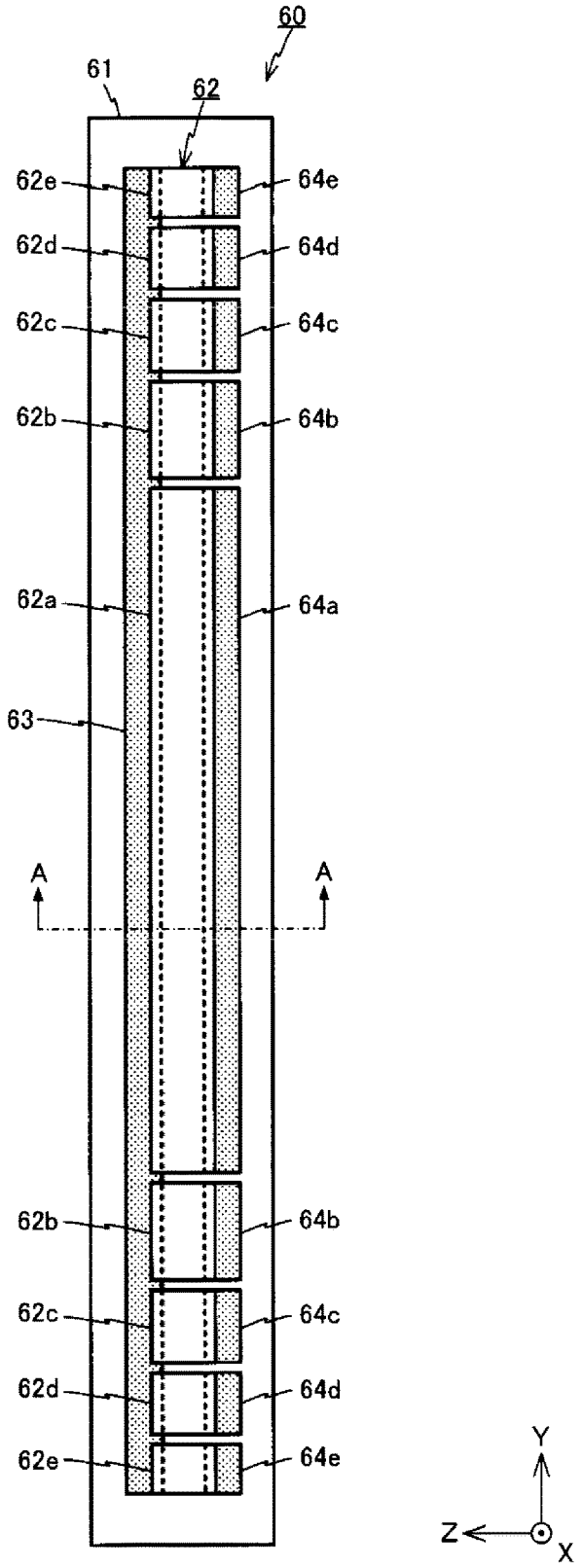
FIG. 5 is a plan view of the heater.

FIG. 5 is a plan view of the heater 60. As illustrated in FIGS. 4 and 5, a heating unit 62*a* is located at a center of an upper surface (−X side surface) of the substrate 61 in the longitudinal direction. Heating units 62*b*, 62*c*, 62*d*, and 62*e* are arranged in an order toward both ends of the substrate 61 in the Y axis direction with the heating unit 62*a* as a center. The heating units 62*a* to 62*e* are arranged along a straight line parallel to the Y axis. The widths of the heating units 62*a* to 62*e* in the Y axis direction are determined according to the size of the paper P used in the image forming apparatus 10. For example, a distance from −Y side end of the heating unit 62*e* positioned at −Y side end of the heater 60 to +Y side end of the heating unit 62*e* positioned at +Y side end of the heater 60 is equal to the length of an A4 size paper P in the longitudinal direction of the A4 size paper P. For example, a distance from −Y side end of the heating unit 62*d* positioned at the −Y side end of the heater 60 to +Y side end of the heating unit 62*d* positioned at +Y side end of the heater 60 is equal to the length of a B5 size paper P in the longitudinal direction of the B5 size paper P. The dimension of each of the heating units 62*a* to 62*e* is determined according to the size of the paper P. When an image is formed on the paper P, the heating units 62*a* to 62*e* are selectively heated according to the size of the paper P. The heating units 62*a* to 62*e* are formed of, for example, a cermet film including TaSiO, TaSiNO, NbSiO, or TiSiCO based resistive material.

A +Z side end portion of the heating units 62*a* to 62*e* is connected to an electrode 63. −Z side ends of the heating units 62*a* to 62*e* are connected to electrodes 64*a* to 64*e*, respectively. The electrodes 63 and 64*a* to 64*e* are made of a metal having low resistivity such as copper, for example.

Figure 6:
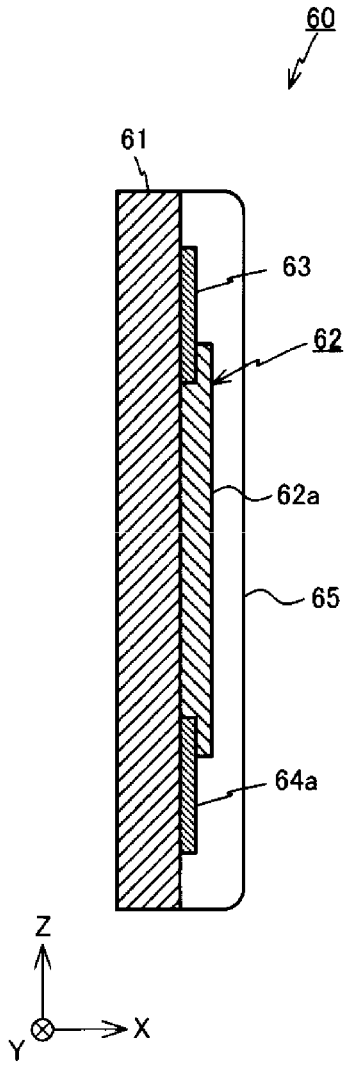
FIG. 6 is a cross sectional view of the heater taken along with line A-A.

FIG. 6 is a view illustrating a cross section taken along with a line A-A of FIG. 5. As can be seen with reference to FIG. 5, the electrode 63 is provided such that −Z side end portion thereof is positioned between the heating units 62*a* to 62*e* and the substrate 61. Similarly, the electrodes 64*a* to 64*e* are provided such that the +Z side end portion thereof is positioned between the heating units 62*a* to 62*e* and the substrate 61.

The heating units 62*a* to 62*e* and the electrodes 63 and 64*a* to 64*e* are covered with a glaze layer 65 formed on +X side surfaces thereof. The glaze layer 65 is, for example, a protective layer containing glass ($SiO_2$) as a main component.

Figure 7:
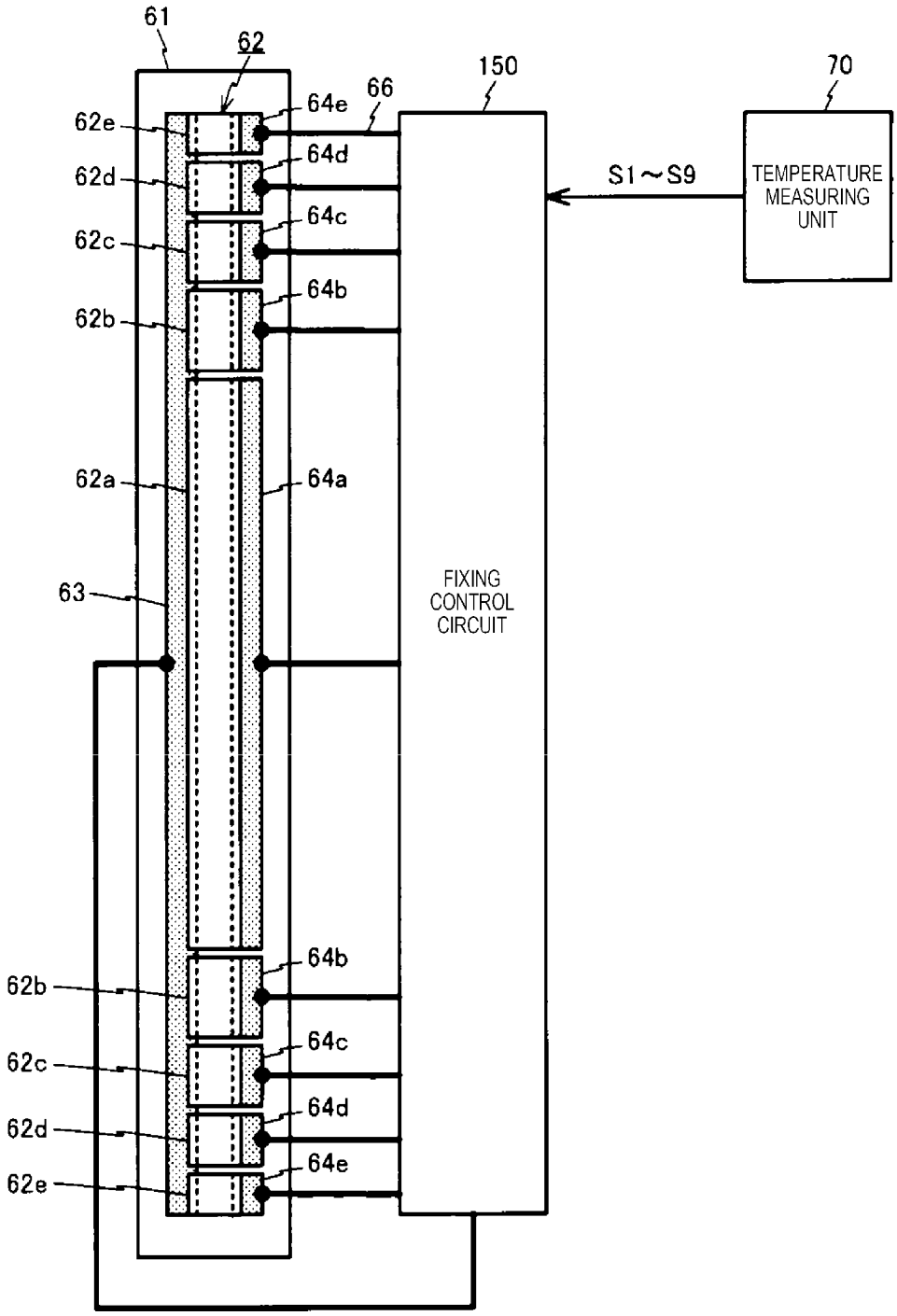
FIG. 7 is a wiring diagram of the heater and a fixing control circuit.

The heater 60 configured as described above is electrically connected to a fixing control circuit 150. FIG. 7 is a wiring diagram of the heater 60 and the fixing control circuit 150 electrically connected to the heater 60. As illustrated in FIG. 7, the fixing control circuit 150 is electrically connected to the electrodes 63 and 64*a* to 64*e* by a wire 66, respectively.

The fixing control circuit 150 selectively applies a voltage to the electrodes 63 and 64*a* to 64*e* based on an output of the temperature measuring unit 70 described later and the like. As a result, the heating units 62*a* to 62*e* of the heater 60 selectively generate heat in accordance with the size of the paper P.

Figure 8:
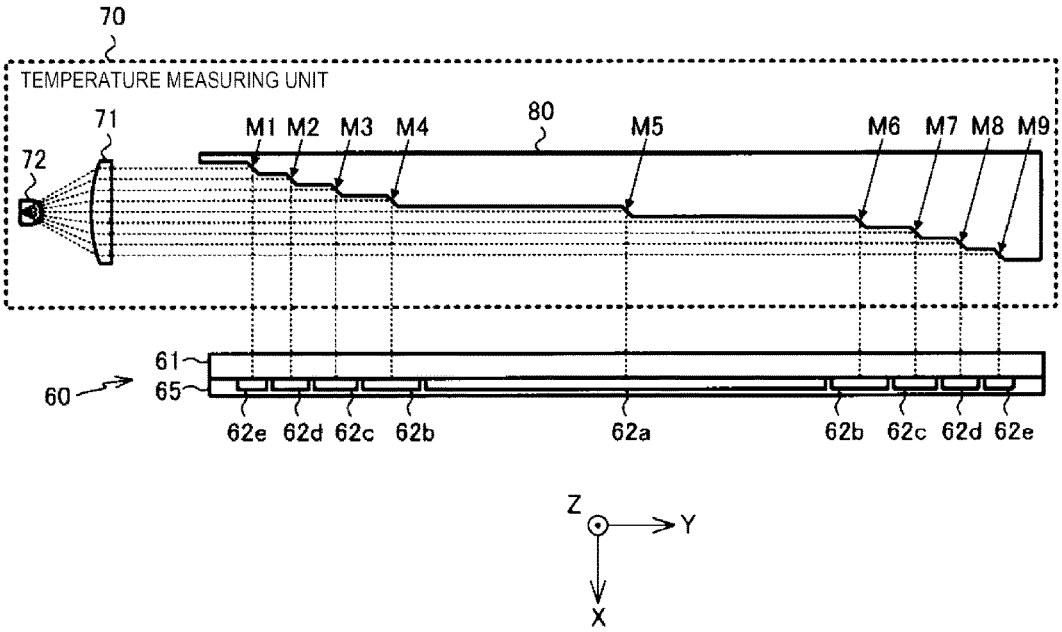
FIG. 8 is a diagram illustrating a configuration of a temperature measuring unit.

FIG. 8 is a diagram illustrating a configuration of the temperature measuring unit 70. The temperature measuring unit 70 includes a temperature measuring element 72, a condenser lens 71, and a light guiding member 80.

Figure 9:
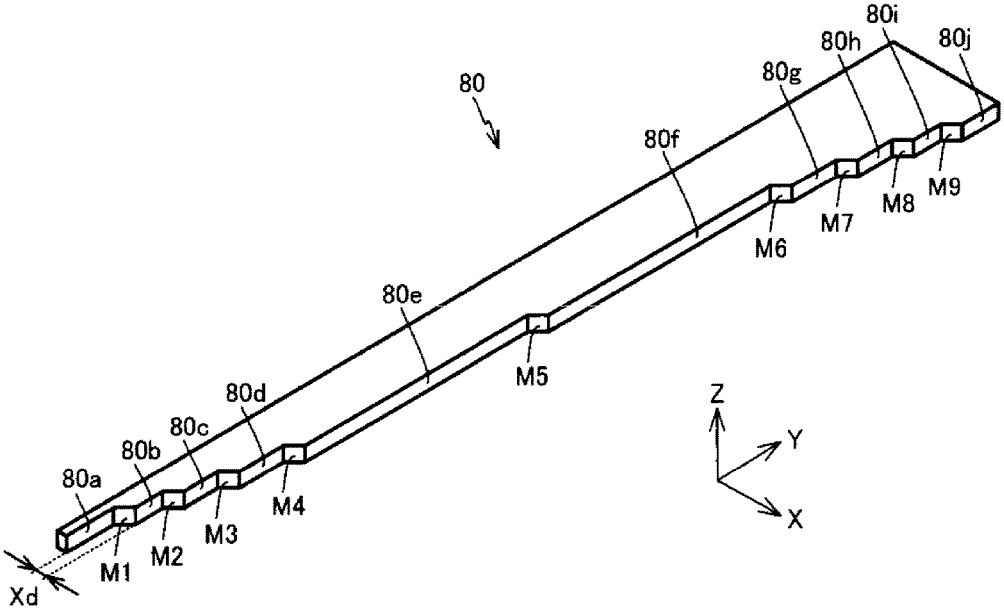
FIG. 9 is a perspective view of a light guiding member.

FIG. 9 is a perspective view of the light guiding member 80. The light guiding member 80 is a plate-like member having a longitudinal direction thereof as the Y axis direction and thickness thereof in the Z axis direction is approximately 5 mm. The light guiding member 80 is made of, for example, aluminum. The side surface on the +X side the light guiding member 80 is shaped like a step as shown in FIG. 9. Specifically, the side surface on the +X side of the light guiding member 80 is configured with flat surfaces 80*a* to 80*j* parallel to a YZ plane and nine reflection surfaces M1 to M9 formed between the flat surfaces 80*a* to 80*j*. Positions of the flat surfaces 80*a* to 80*j* in the X axis direction are different from each other. The flat surfaces 80*a* to 80*j* are arranged at interval Xd along X axis. Therefore, the reflection surfaces M1 to M9 formed between the flat surfaces 80*a* to 80*j* are arranged at the interval Xd in an X axis direction. The reflection surfaces M1 to M9 are inclined by 45 degrees with respect to the YZ plane. In addition, the reflection surfaces M1 to M9 become mirror surfaces (reflection mirror) by polishing or coating with high reflectivity.

As illustrated in FIG. 8, the light guiding member 80 is disposed on an −X side of the heater 60 in a state where a side surface on the −X side is parallel to the YZ plane. In this state, positions of the reflection surfaces M1 to M9 of the light guiding member 80 in the Y axis direction coincide with the positions of the heating units 62*a* to 62*e* of the heater 60 in the Y axis direction.

The condenser lens 71 is a lens having a longitudinal direction thereof as the X axis direction. The condenser lens 71 is formed of a resin or glass. The condenser lens 71 is a lens having a power (reflective power) for converging light entering from +Y side surface thereof in the X axis direction. The size of the condenser lens 71 in the X axis direction is larger than the size of the light guiding member 80 in the X axis direction. The condenser lens 71 is disposed on −Y side of the light guiding member 80.

Figure 10:
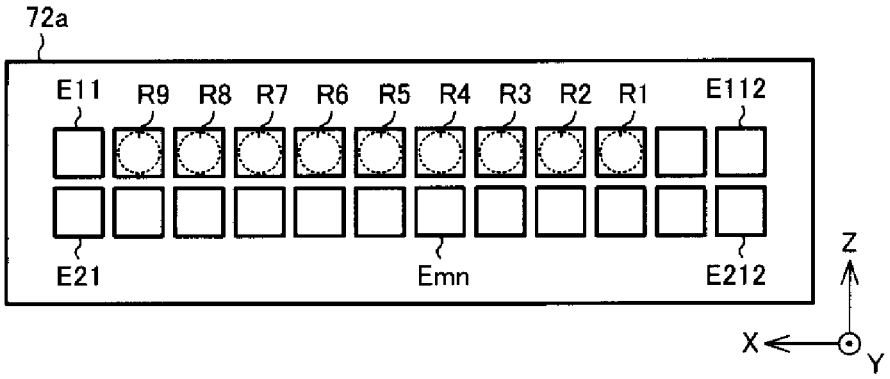
FIG. 10 is a diagram schematically illustrating a light receiving surface of a temperature measuring element.

The temperature measuring element 72 is a thermopile array sensor. FIG. 10 is a diagram schematically illustrating alight receiving surface 72*a* of the temperature measuring element 72. As illustrated in FIG. 10, the temperature measuring element 72 includes, for example, twenty-four light receiving elements Emn arranged in two rows and twelve columns. Each light receiving element Emn outputs a signal corresponding to intensity of incident infrared rays. The temperature measuring element 72 is disposed at −Y side of the condenser lens 71 in a state where the light receiving surface 72*a* is parallel to an XZ plane.

In the temperature measuring unit 70 configured as described above, the infrared rays emitted from the heating units 62*a* to 62*e* via the substrate 61 are incident on the reflection surfaces M1 to M9 of the light guiding member 80, respectively, by the heat generated from the heating units 62*a* to 62*e* of the heater 60. The infrared rays incident on the reflection surfaces M1 to M9 are reflected in a −Y direction. As a result, the nine parallel infrared rays arranged at an equal interval Xd in the X axis direction are incident on the condenser lens 71. The nine infrared rays incident on the condenser lens 71 converge by the condenser lens 71 and are incident on the temperature measuring element 72.

As illustrated in FIG. 10, the infrared rays incident on the temperature measuring element 72 are incident on any of the twenty-four light receiving elements Emn formed in the temperature measuring element 72, respectively. As illustrated in FIG. 10, in the temperature measuring unit 70, the infrared rays R1 to R9 reflected by the reflection surfaces M1 to M9 are incident on light receiving elements E12 to E110, respectively. Signals S1 to S9 are output from the temperature measuring element 72 according to the intensity of the infrared rays R1 to R9. As illustrated in FIG. 7, the signals S1 to S9 are output to the fixing control circuit 150.

Back to FIG. 3, the press roller 52 is provided with a metallic core material 52*a* having a longitudinal direction thereof as the Y axis direction and a rubber layer 52*b* stacked on the outer peripheral surface of the core material. The length of the press roller 52 is approximately the same as the length of the fixing belt 51 in its longitudinal direction. The press roller 52 is urged to a direction (−X direction) toward the fixing belt 51 by an elastic member (not illustrated). As a result, the press roller 52 is pressed against the heater 60 across the fixing belt 51. Accordingly, a surface of the press roller 52 and an outer circumferential surface of the fixing belt 51 come into pressure contact with each other to form a nip.

In the fixing device 50 configured as described above, as the press roller 52 rotates, the paper P passes through the nip formed between the press roller 52 and the fixing belt 51 that rotate in the direction of the arrows illustrated in FIG. 3, respectively. As a result, the toner image formed on the paper P is fixed onto the paper P.

Figure 11:
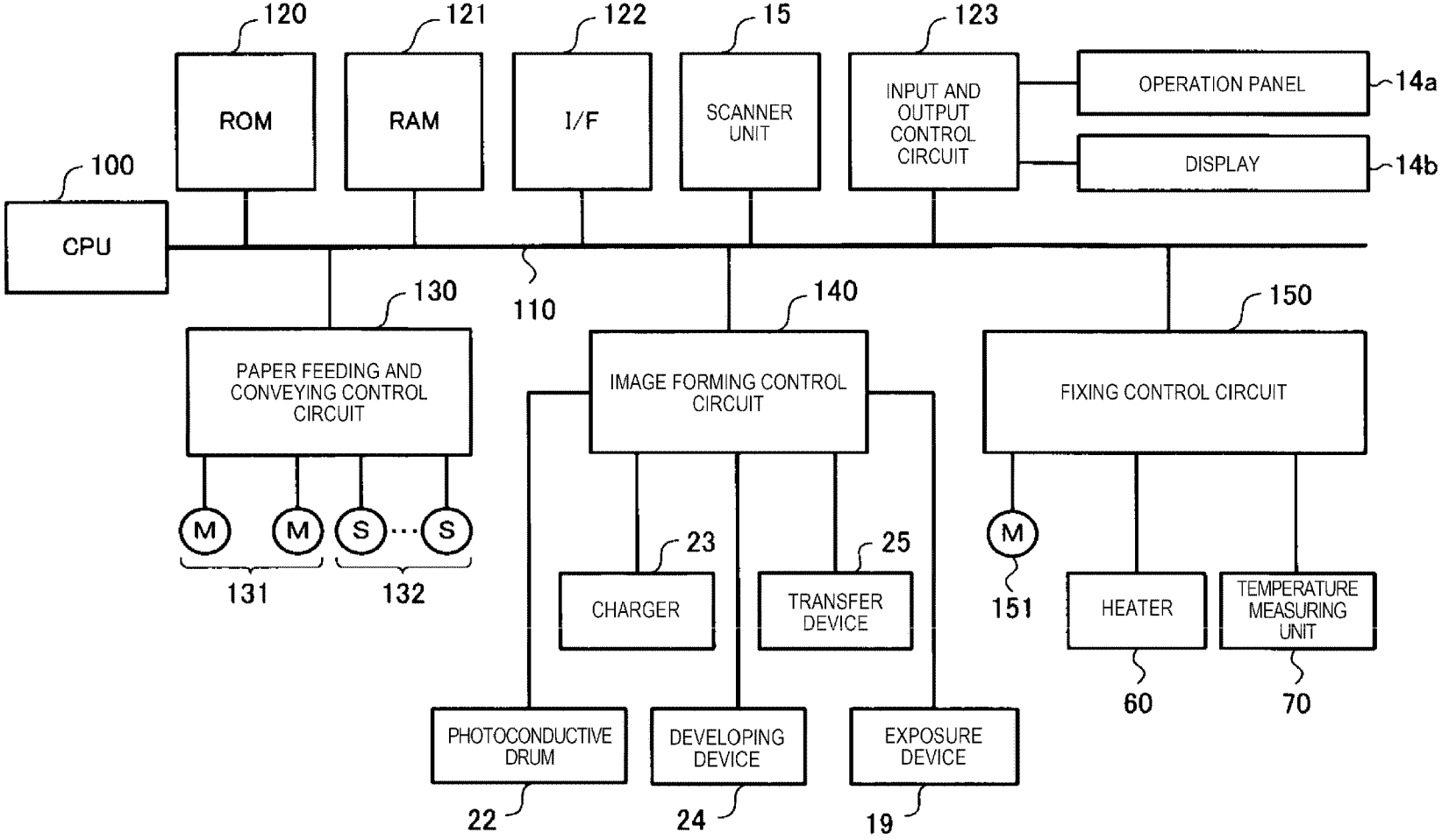
FIG. 11 is a block diagram of a control system of the image forming apparatus.

FIG. 11 is a block diagram of a control system of the image forming apparatus 10. The control system is provided with, for example, a CPU 100 that controls entirety of the image forming apparatus, a bus line 110, a read only memory (ROM) 120, a random access memory (RAM) 121, an interface 122, the scanner unit 15, an input and output control circuit 123, a paper feeding and conveying control circuit 130, an image forming control circuit 140, and the fixing control circuit 150. The CPU 100 and each circuit are connected to each other via the bus line 110.

The CPU 100 is configured to control the entire image forming apparatus and performs a processing function for forming an image on a paper P by executing a program stored in the ROM 120 or the RAM 121. The ROM 120 stores a control program for controlling basic operations of an image forming process, control data, and the like. The RAM 121 functions as a working memory.

The ROM 120 (or RAM 121) stores, for example, a control program of the image forming unit 17, the fixing device 50, or the like and various types of control data used by the control program.

A control program for fixing temperature of the fixing device 50 includes a determination logic that determines a size of an image forming region on a paper on which a toner image is formed and a heat control logic for heating the heating units 62*a* to 62*e* corresponding to a position that the image forming region passes before the paper is conveyed into the fixing device 50.

The interface 122 performs communication with various devices such as a user terminal or a facsimile. The input and output control circuit 123 controls an operation panel 14*a* and a display 14*b*. By operating the operation panel 14*a* with a user, it is possible to designate, for example, the paper size, the number of copies of an original document and the like.

The paper feeding and conveying control circuit 130 controls a motor group 131 that drives the pickup roller 18*a*, the paper feeding roller 35, the paper discharge roller 37 of a conveyance path, or the like. The paper feeding and conveying control circuit 130 controls the motor groups 131 according to detection results of various sensors 132 in the vicinity of the paper feeding cassette 18 or on the conveyance path based on a control signal from the CPU 100.

The image forming control circuit 140 controls the photoconductive drum 22, the electrostatic charger 23, the scan heads 19Y, 19M, 19C, and 19K, the developing device 24, and the primary transfer roller 25, respectively based on the control signal from the CPU 100.

The fixing control circuit 150 controls a driving motor 151 that rotates the press roller 52 of the fixing device 50 based on the control signal from the CPU 100. In addition, the fixing control circuit 150 drives the heater 60 based on the output from the temperature measuring unit 70, the size of the paper P notified from the CPU, and the like.

Next, a printing process of the image forming apparatus 10 configured as described above will be explained. The printing process of the image forming apparatus 10 is performed when printing image data received via the interface 122 or printing the image data generated by the scanner unit 15.

In the printing process, as illustrated in FIG. 1, the paper P is fed from the paper feeding cassette 18 by the pickup roller 18*a* and is conveyed between the intermediate transfer belt 21 and the secondary transfer roller 33 by the paper feeding roller 35.

In parallel with above-described operation, in the image forming units 20Y, 20M, 20C, and 20K, toner images are formed on the outer circumferential surfaces of each photoconductive drum 22. The toner images formed on each photoconductive drum 22 of the image forming units 20Y, 20M, 20C, and 20K are sequentially transferred to the outer circumferential surfaces of the intermediate transfer belt 21. As a result, a toner image formed of a yellow (Y) toner, a magenta (M) toner, a cyan (C) toner, and a black (K) toner is formed on the intermediate transfer belt 21.

When the paper P conveyed between the intermediate transfer belt 21 and the secondary transfer roller 33 passes between the intermediate transfer belt 21 and the secondary transfer roller 33, the toner image formed on the intermediate transfer belt 21 is transferred onto the paper P. As a result, a toner image formed with toners of yellow (Y), magenta (M), cyan (C), and black (K) is formed on the paper P.

The paper P on which the toner image is formed passes through the fixing device 50. At this time, the fixing control circuit 150 selects the heating units 62*a* to 62*e* to be energized according to the size of the paper P. Then, the fixing control circuit 150 receives the signals S1 to S9 output from the temperature measuring unit 70 and applies a voltage to the selected heating units among the heating units 62*a* to 62*e* while monitoring the temperatures of the heating units 62*a* to 62*e* of the heater 60 to heat the heating units 62*a* to 62*e* at a predetermined temperature respectively. The paper P is heated by passing through the fixing device 50. As a result, the toner image transferred onto the paper P is fixed onto the paper P and an image is formed on the paper P. The paper P on which an image is formed is discharged to the paper discharge portion 38 by the paper discharge roller 37.

As described above, in the temperature measuring unit 70 according to the present embodiment, as can be seen with reference to FIG. 8, the infrared rays according to the intensity of the temperature of the heating units 62*a* to 62*e* are emitted from the heating units 62*a* to 62*e* of the heater 60 via the substrate 61. Each infrared ray emitted from the heating units 62*a* to 62*e* is reflected by the reflection surfaces M1 to M9 of the light guiding member 80 and is incident on the condenser lens 71 in a mutually parallel state. Each infrared ray converges by the condenser lens 71 and is received by a common temperature measuring element 72. For this reason, even though there are a plurality of heating units of the heater 60, it is possible to measure the temperature of each heating units 62*a* to 62*e* by one temperature measuring element 72. Accordingly, there is no need to dispose a sensor for each of the heating units independently, and it is possible to simplify the configuration of the image forming apparatus.

Figure 12:
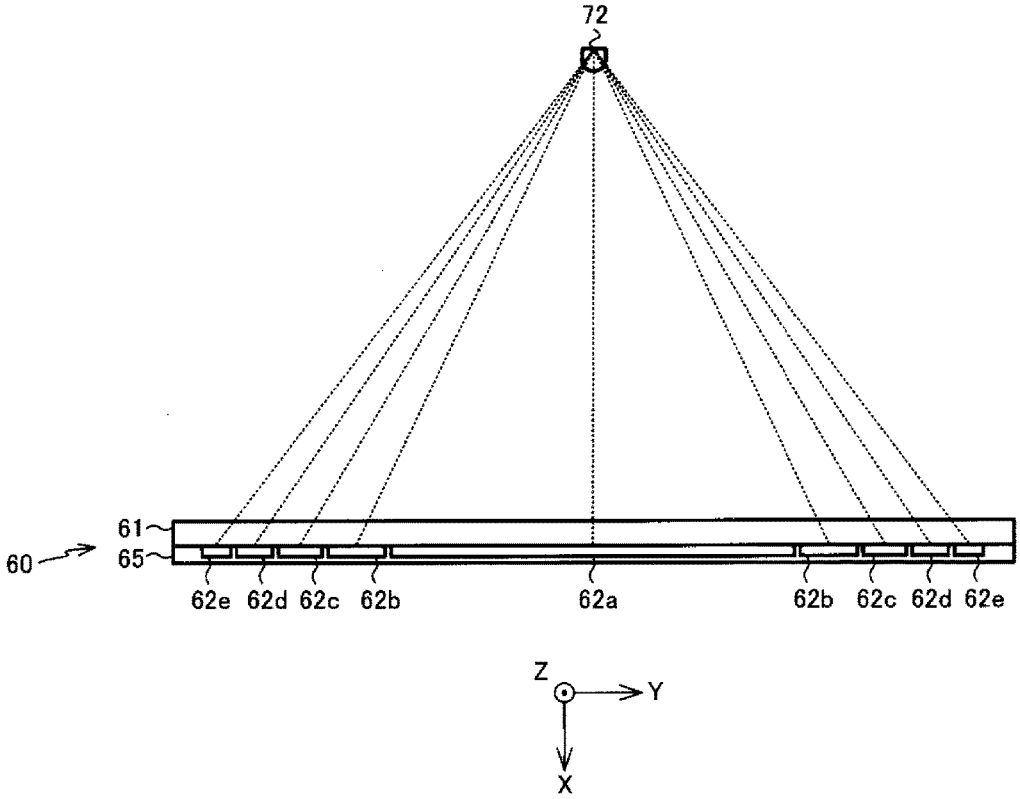
FIG. 12 is a diagram for explaining an example of related art.

Consider a case where a thermopile array sensor is used as a temperature measuring element 72, and a plurality of objects to be measured are arranged on a straight line like the heating units 62*a* to 62*e* of the heater 60. In general, when measuring a temperature using the thermopile array sensor, the objects to be measured needs to be positioned within the field view of the thermopile array sensor. Accordingly, as illustrated in FIG. 12, when measuring the temperature of the heating units 62*a* to 62*e* without using the light guiding member 80, the temperature measuring element 72 needs to be positioned on the −X side of the heater 60 apart from the heater 60. Specifically, the temperature measuring element 72 needs to be positioned approximately 200 mm to 500 mm away from the heater 60. For this reason, in the related art, it was difficult to measure the temperature of the heater 60 disposed inside the fixing belt 51 with the thermopile array sensor.

In the temperature measuring unit 70 according to the present embodiment, as illustrated in FIG. 8, each infrared ray emitted from the heater 60 is reflected along the heater 60 by the light guiding member 80, and is condensed on the temperature measuring element 72 by the condenser lens 71. For this reason, the temperatures of the plurality of the heating units 62*a* to 62*e* provided on the heater 60 that is disposed inside the fixing belt 51 can be measured using one thermopile array sensor. Accordingly, it is possible to simplify the configuration of the image forming apparatus, and enhance flexibility of design as a result.

The light guiding member 80 according to the present embodiment, for example, is made of metal such as aluminum and the like. For this reason, the reflected infrared rays are not absorbed, and the temperatures of the heating units 62*a* to 62*e* of the heater 60 can be measured accurately.

The above-described embodiment is given as an example and is not limiting. For example, in the above-described embodiment, the light guiding member 80 is configured with a plate-like member made of aluminum. However, the configuration of the light guiding member 80 can be varied. Hereinafter, modification examples of the light guiding member 80 will be described.

Modification Example 1

Figure 13:
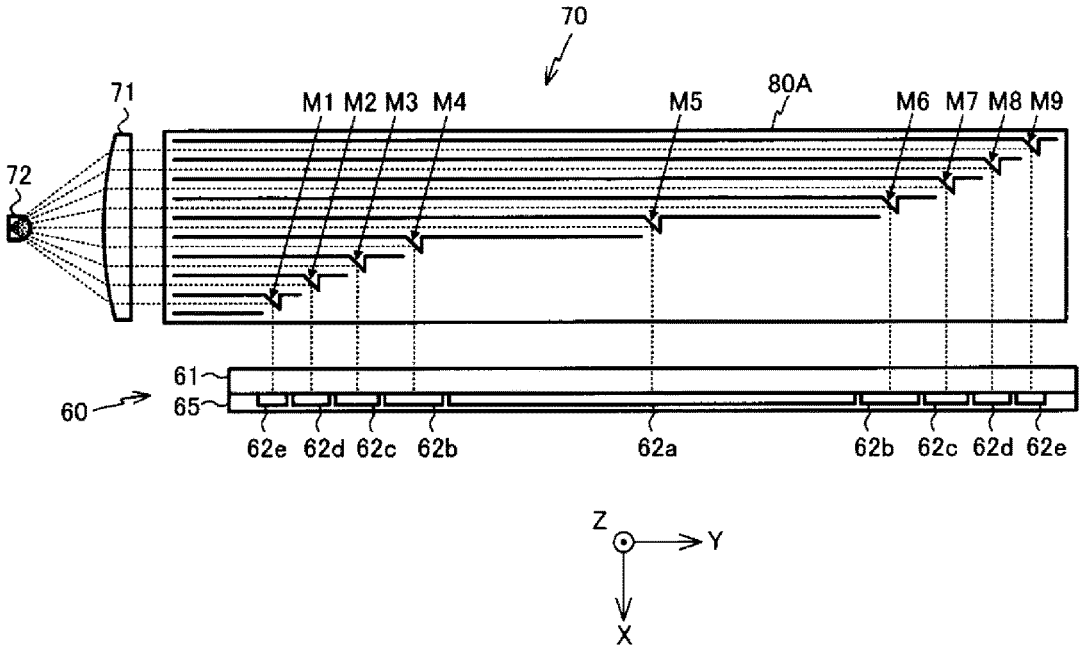
FIG. 13 is a diagram illustrating a configuration of the temperature measuring unit provided with a light guiding member according to a modification example.

FIG. 13 is a diagram illustrating a configuration of the temperature measuring unit 70 provided with the light guiding member 80A according to a modification example. The light guiding member 80A is different from the light guiding member 80 in that the light guiding member 80A is made of a thin metal plate.

Figure 14:
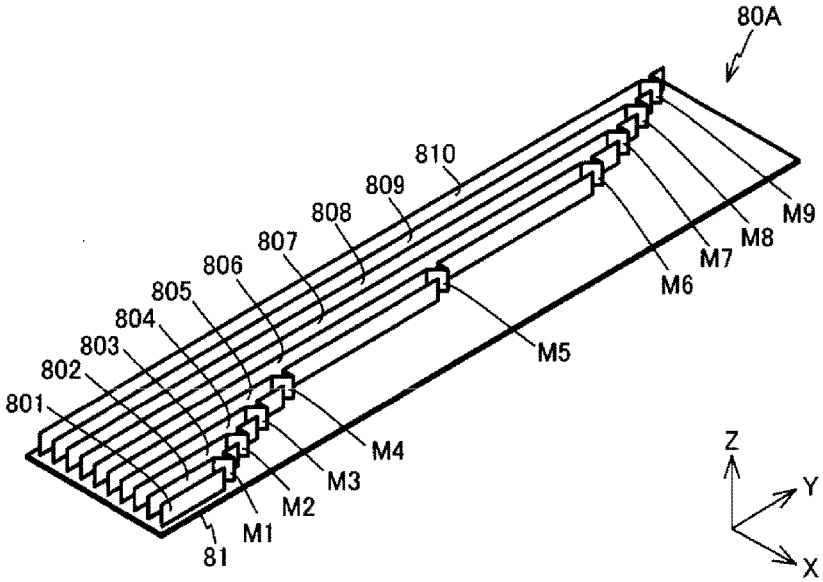
FIG. 14 is a perspective view illustrating the light guiding member according to the modification example.

FIG. 14 is a perspective view illustrating the light guiding member 80A. As illustrated in FIG. 14, the light guiding member 80A is configured with a base 81 composed of a thin rectangular plate formed of aluminum or stainless steel and partition walls 801 to 810 made of a thin plate the same as the base 81. The base 81 is shaped into a rectangular having a longitudinal direction thereof as the Y axis direction.

Each of the partition walls 801 to 810 has substantially the same height, for example. Each of the partition walls 801 to 810 has a longitudinal direction thereof as the Y axis direction, and is fixed to the base 81 in a state arranged at an equal interval along the X axis. On the partition walls 802 to 810 except from the partition board 801, the reflection surfaces M1 to M9 that are inclined by 45 degrees with respect to the YZ plane are formed by bending three portions in the middle. The reflection surfaces M1 to M9 become a mirror surface by polishing or coating with high reflectivity.

As illustrated in FIG. 13, the light guiding member 80A is disposed on the −X side of the heater 60 such that a main surface except for the bent portion of each of the partition walls 801 to 810 is parallel to the YZ plane. In such a state, the positions of the reflection surfaces M1 to M9 formed on each partition walls 802 to 810 in the Y axis direction coincide with the positions of the heating units 62*a* to 62*e* of the heater 60 in the Y axis direction. The light guiding member 80A configured as described above functions the same as the light guiding member 80.

The temperature measuring unit 70 provided with the light guiding member 80A can measure the temperature of each heating units 62*a* to 62*e* with one temperature measuring element 72 even though there are a plurality of heating units of the heater 60. Accordingly, it is possible to simplify the configuration of the image forming apparatus.

Modification Example 2

Figure 15:
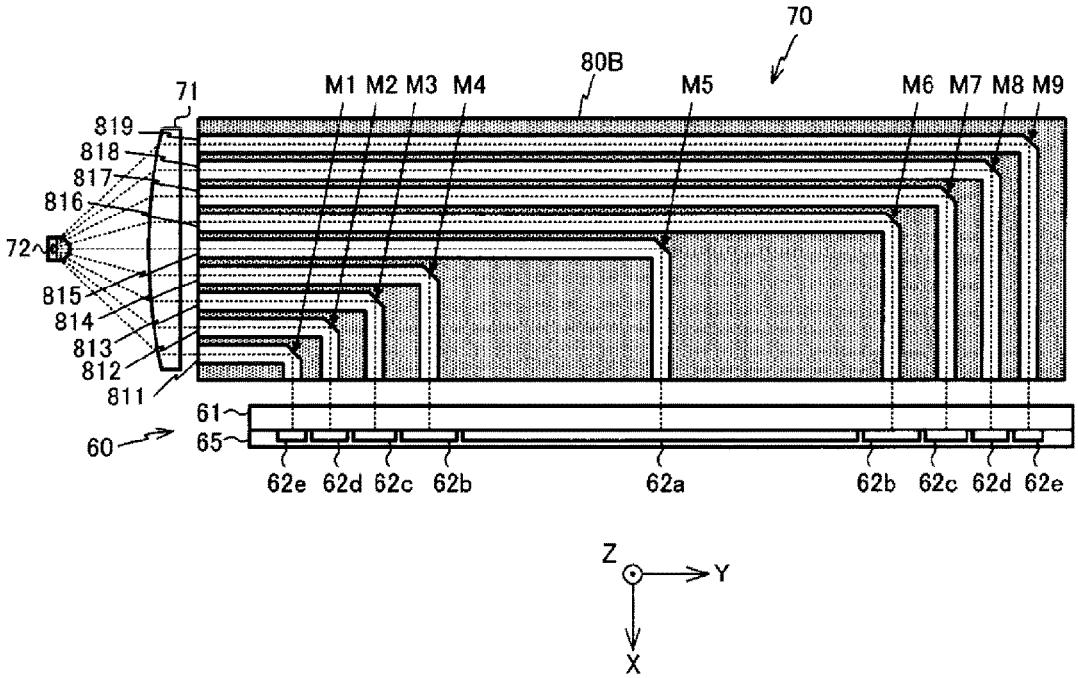
FIG. 15 is a diagram illustrating a configuration of the temperature measuring unit provided with the light guiding member according to the modification example.

FIG. 15 is a diagram illustrating a configuration of the temperature measuring unit 70 provided with the light guiding member 80B according to the modification example. The light guiding member 80B is different from the light guiding members 80 and 80A in that the light guiding member 80B is made of a metallic plate having curved grooves formed therein.

Figure 16:
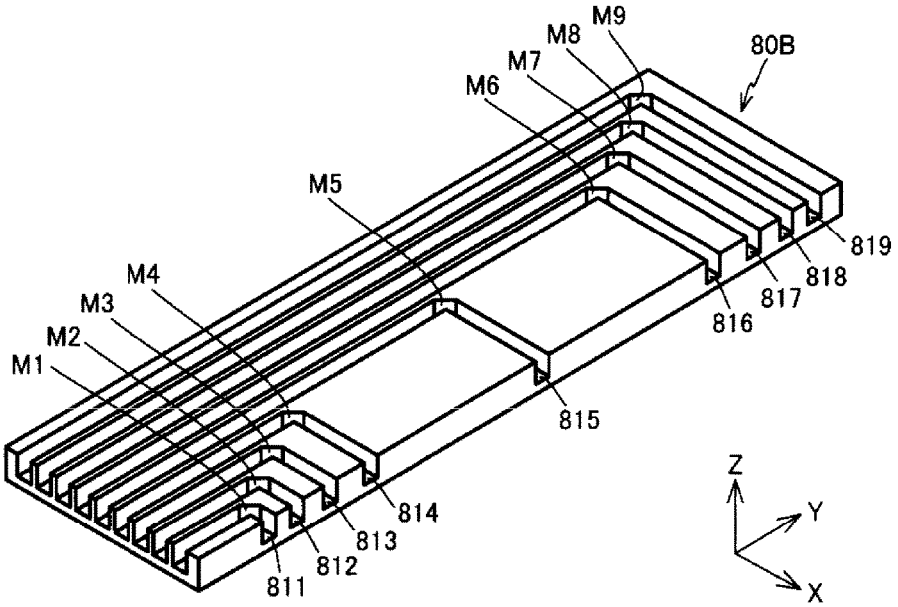
FIG. 16 is a perspective view of the light guiding member according to the modification example.

FIG. 16 is a perspective view of the light guiding member 80B. As illustrated in FIG. 16, the light guiding member 80B is formed of a rectangular member made of metal such as aluminum that can be easily processed. Nine L-shaped grooves 811 to 819 are formed on a surface of the light guiding member 80B. The grooves 811 to 819 are formed of two portions parallel to the X axis and Y axis, and the reflection surfaces M1 to M9 inclined by 45 degrees with respect to the YZ plane and are mirror surfaces are formed in the corner portion of the L-shaped groove that the above-described two portions intersect with each other.

As illustrated in FIG. 15, the light guiding member 80B is disposed on the −X side of the heater 60 having the longitudinal direction thereof as the Y axis direction. In such a state, a portion of the grooves 811 to 819 parallel in the X axis and positions of the reflection surfaces M1 to M9 in the Y axis direction coincide with the positions of the heating units 62*a* to 62*e* of the heater 60 in the Y axis direction. The light guiding member 80B configured as described above function as the same as the light guiding members 80 and 80A.

The temperature measuring unit 70 provided with the light guiding member 80B can measure the temperature of each of the heating units 62*a* to 62*e* by one temperature measuring element 72 even though there are a plurality of heating units of the heater 60. Accordingly, it is possible to simplify the configuration of the image forming apparatus.

Modification Example 3

Figure 17:
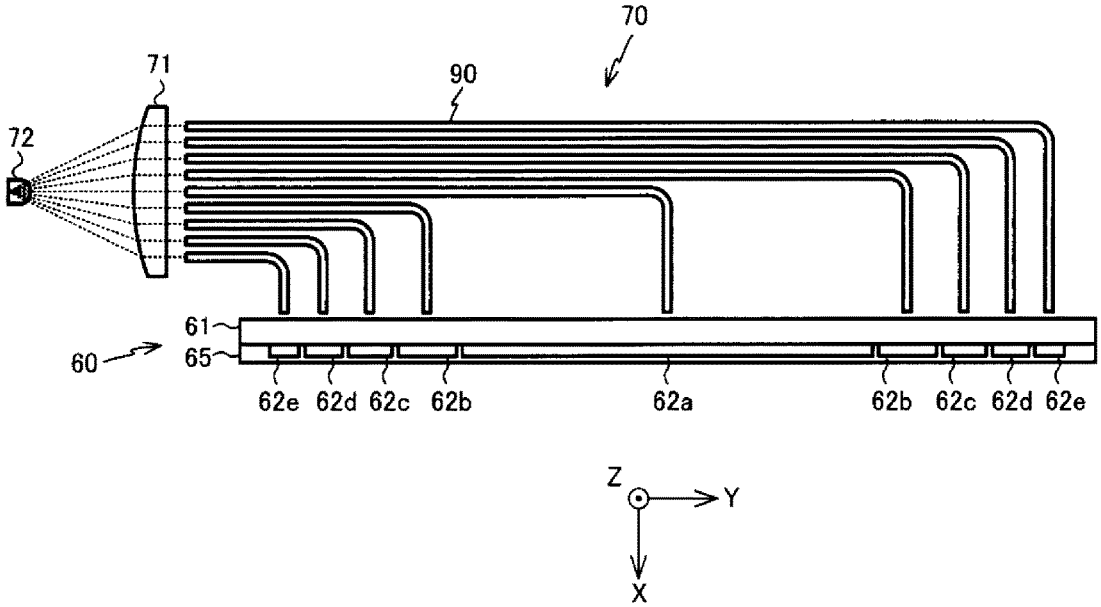
FIG. 17 is a diagram illustrating a configuration of the temperature measuring unit according to the modification example.

FIG. 17 is a diagram illustrating a configuration of the temperature measuring unit 70 according to the modification example. In the temperature measuring unit 70 according to the present modification example, the light guiding members 80, 80A, and 80B are replaced with L-shaped optical fibers 90 that can guide the infrared ray toward the condenser lens 71. Each of the optical fibers 90 is extended around the −Y side of each heating units 62*a* to 62*e* in a state where one end portion thereof is perpendicular to the heating units 62*a* to 62*e* of the heater 60. Each of the optical fibers 90 is extended around in a vicinity of the condenser lens 71 in a state where the other end portion of thereof is parallel to the Y axis.

As the heating units 62*a* to 62*e* of the heater 60 generate heat, the infrared rays emitted from the heating units 62*a* to 62*e* via the substrate 61 are incident on each end of the optical fibers 90. The infrared rays incident on the optical fibers 90 are emitted from the other end of the optical fibers 90, and are incident on the condenser lens 71. The infrared rays incident on the condenser lens 71 are converged by the condenser lens 71 and are incident on the temperature measuring element 72.

Accordingly, in the temperature measuring unit 70 according to the present modification example, it is possible to measure a temperature of each of the heating units 62*a* to 62*e* with one temperature measuring element 72 even though there are a plurality of heating units of the heater 60. Therefore, it is possible to simplify the configuration of the image forming apparatus.

Figure 18:
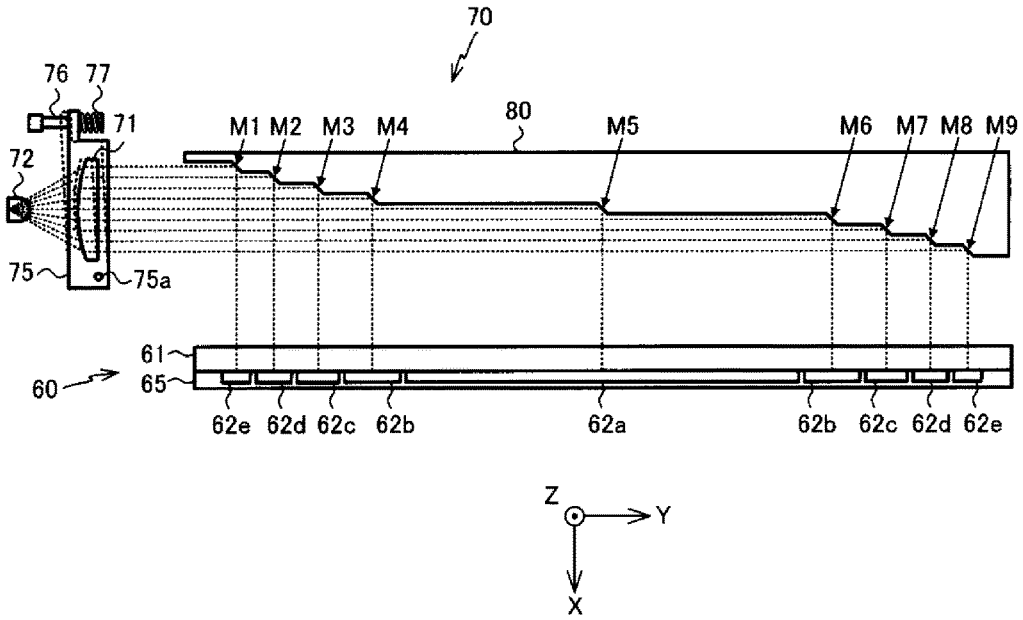
FIG. 18 is a diagram illustrating a support structure of a condenser lens.

In the temperature measuring units 70 according to above-described embodiment and modification examples, posture of the condenser lens 71 may be adjusted. In the example illustrated in FIG. 18, the condenser lens 71 is disposed on a support plate 75 rotatable around a shaft 75*a* parallel to the Z axis. The support plate 75 is positioned such that −X side end portion thereof is interposed between a press spring 77 stretchable in the Y axis direction and an adjusting screw 76 movable in the Y axis direction. A user of an operator of the image forming apparatus 10 can rotate the condenser lens 71 around the shaft 75*a* with the support plate 75 by rotating and moving the adjusting screw 76 in the Y axis direction. As a result, it is possible to finely adjust the positions that the infrared rays incident on the temperature measuring element 72 converge. The support plate 75 supporting the condenser lens 71 may be movable in the X axis direction and Y axis direction.

Figure 19:
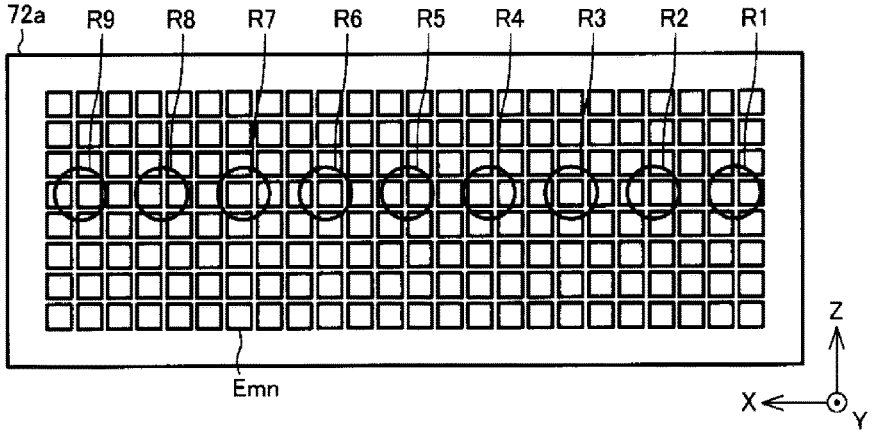
FIG. 19 is a diagram schematically illustrating a light receiving surface of a temperature measuring element according to the modification example.

In the above-described embodiment, as illustrated in FIG. 10, an example of the temperature measuring element 72 being provided with twenty-four light receiving elements Emn arranged in two rows and twelve columns was explained. However, the temperature measuring element 72 may be provided with nine or more and twenty-three or less light receiving elements, or twenty-five or more light receiving elements. As illustrated in FIG. 19, each of the infrared rays R1 to R9 may be received by a plurality of light receiving elements Emn. In this case, the total of values indicated by the signal of the light receiving element Emn on which one infrared ray is incident indicates the temperature of one heating unit.

In the above-described embodiment, as illustrated in FIG. 8, a case of the heater 60 having nine the heating units 62*a* to 62*e* was explained. However, the heater 60 may have ten or more heating units. In this case, the temperatures of the plurality of the heating units can be measured with one temperature measuring element 72 using a thermopile array sensor having light receiving elements Emn more than the number of the heating units as the temperature measuring element 72.

In the above-described embodiment, a control program and control data of the fixing device 50 were stored in a storage device of the image forming apparatus, and was executed by the CPU 100. However, an arithmetic processing device for the fixing device 50 and a storage device may be provided separately.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A temperature measuring device for measuring temperatures of a plurality of heating elements, comprising:

a temperature measuring element positioned to receive infrared rays emitted from each of the heating elements and to output a signal corresponding to an intensity of the light reception; and a light guiding unit including a plurality of light guides, one for each of the heating elements, each light guide being configured to guide the infrared ray emitted from a respective one of the heating elements to the temperature measuring element, wherein the heating elements are arranged in a straight line, each light guide includes a portion that reflects the infrared ray emitted from the respective one of the heating elements to the temperature measuring element, and the portions of the light guides are configured to reflect the infrared rays emitted from the respective heating elements in directions that are parallel to each other.

2. The device according to claim 1, wherein the light guiding unit further includes:

a condenser lens that condenses each of the infrared rays reflected by the light guides to the temperature measuring element.

3. The device according to claim 2, wherein the condenser lens is mounted on a support plate that is movable to adjust a posture of the condenser lens.

4. The device according to claim 1, wherein the portions of the light guides are each a reflection mirror.

5. The device according to claim 1, wherein the light guides are each an optical fiber.

6. The device according to claim 1, wherein the temperature measuring element is a thermopile array sensor.

7. A fixing device comprising:

a rotatable fixing belt;

a heater disposed on an inner side of the fixing belt and having a plurality of heating elements;

a roller disposed adjacent to the fixing belt and configured to press the fixing belt against each of the heating elements;

a temperature measuring element positioned on the inner side of the fixing belt to receive infrared rays emitted from each of the heating elements and to output a signal corresponding to an intensity of the light reception; and a light guiding unit positioned on the inner side of the fixing belt, the light guiding unit including a plurality of light guides, one for each of the heating elements, each light guide being configured to guide the infrared ray emitted from a respective one of the heating elements to the temperature measuring element, wherein the heating elements are arranged in a straight line, each light guide includes a portion that reflects the infrared ray emitted from the respective one of the heating elements to the temperature measuring element, and the portions of the light guides are configured to reflect the infrared rays emitted from the respective heating elements in directions that are parallel to each other.

8. The device according to claim 7, wherein the light guiding unit further includes:

a condenser lens that condenses each of the infrared rays reflected by the light guides to the temperature measuring element.

9. The device according to claim 8, wherein the condenser lens is mounted on a support plate that is movable to adjust a posture of the condenser lens.

10. The device according to claim 7, wherein the portions of the light guides are each a reflection mirror.

11. The device according to claim 7, wherein the light guides are each an optical fiber.

12. The device according to claim 7, wherein the temperature measuring element is a thermopile array sensor.

13. An image forming apparatus comprising:

a transfer belt from which a toner image is transferred onto a medium;

an image forming unit configured to form the toner image on the transfer belt;

a rotatable fixing belt;

a heater disposed on an inner side of the fixing belt and having a plurality of heating elements;

a roller disposed adjacent to the fixing belt and configured to press the fixing belt against each of the heating elements;

a temperature measuring element positioned on the inner side of the fixing belt to receive infrared rays emitted from each of the heating elements and to output a signal corresponding to an intensity of the light reception;

a light guiding unit positioned on the inner side of the fixing belt, the light guiding unit including a plurality of light guides, one for each of the heating elements, each light guide being configured to guide the infrared ray emitted from a respective one of the heating elements to the temperature measuring element; and a control unit configured to control the heater based on an output from the temperature measuring element, wherein the heating elements are arranged in a straight line, each light guide includes a portion that reflects the infrared ray emitted from the respective one of the heating elements to the temperature measuring element, and the portions of the light guides are configured to reflect the infrared rays emitted from the respective heating elements in directions that are parallel to each other.

14. The apparatus according to claim 13, wherein the light guiding unit further includes:

a condenser lens that condenses each of the infrared rays reflected by the light guides to the temperature measuring element.

* * * * *